US006614726B2

(12) United States Patent
Yamasaki et al.

(10) Patent No.: US 6,614,726 B2
(45) Date of Patent: Sep. 2, 2003

(54) STOPWATCH

(75) Inventors: Masaharu Yamasaki, Chiba (JP); Curtis Milander, Beaverton, OR (US)

(73) Assignees: Seiko Instruments Inc. (JP); Nike, Inc. (JP)

( * ) Notice: Subject to any disclaimer, the term of this patent is extended or adjusted under 35 U.S.C. 154(b) by 0 days.

(21) Appl. No.: 09/777,104

(22) Filed: Feb. 5, 2001

(65) Prior Publication Data

US 2001/0014056 A1 Aug. 16, 2001

(30) Foreign Application Priority Data

Feb. 9, 2000 (JP) ..... 2000-032168
Oct. 26, 2000 (JP) ..... 2000-326469

(51) Int. Cl.[7] ..... G04F 8/00; G04F 10/00; G04B 47/00

(52) U.S. Cl. ..... 368/110; 368/10; 368/11; 368/111; 368/112; 368/113

(58) Field of Search ..... 368/1–327

(56) References Cited

U.S. PATENT DOCUMENTS 4,533,256 A * 8/1985 Ostendorf ..... 368/11
4,694,694 A * 9/1987 Vlakancic ..... 73/386
5,224,059 A * 6/1993 Nitta ..... 364/558
6,144,619 A * 11/2000 Reisman ..... 368/10

FOREIGN PATENT DOCUMENTS

JP 363121779 A * 5/1988 ..... 368/11

* cited by examiner

*Primary Examiner*—David Martin
*Assistant Examiner*—Michael L. Lindinger
(74) *Attorney, Agent, or Firm*—Adams & Wilks

(57) ABSTRACT

A stopwatch has a measuring section for measuring a primary physical quantity, a memory section for previously storing as a target value the value of the primary physical quantity at a point where a time is to be recorded, and recording sections for recording a measured value of time at a time point when the value measured by the measuring section becomes equal to the target value, after initiation of measurement of time. The target value is, for example, a value actually recorded before initiation of measurement of time by the measuring section at the point where time is to be recorded.

12 Claims, 10 Drawing Sheets

STOPWATCH

BACKGROUND OF THE INVENTION

1. Field of the Invention

The present invention relates to a stopwatch, and more particularly, to a stopwatch suitable for timing performed by a person for himself/herself.

2. Description of the Prior Art

An impact-responsive stopwatch (e.g., one disclosed in Japanese Patent Application Laid-Open No. Sho 63-127183) is known which is designed to enable a person taking part in a sport to measure and record time without a risk of a violent fall, and which is used in such a manner that the user gives an impact to the stopwatch by a striking action or the like to record or hold a split time at an intermediate point and to stop timing at a goal point.

However, there is a possibility of the stopwatch receiving impacts from various causes while engaged in a sport. For example, in a case where an impact-responsive stopwatch of this kind is used in a skiing downhill race, an impact may be caused by violent stock work or striking against a pole and may result in recording of an erroneous split time or termination of timing before the actual goal point is reached due to misidentification of an intermediate point as a goal point. Thus, it is difficult to perform timing in accordance with one's intention.

A technique for preventing an impact given in a predetermined time period after start of timing from being accepted as a split-time recording command in an impact-responsive stopwatch of this kind has also been proposed (Japanese Utility Model Application Laid-open No. Hei 5-59389). This technique, however, has the timing error prevention effect only during a predetermined period after a start of timing.

SUMMARY OF THE INVENTION

The present invention has been achieved in view of the above-described circumstances, and an object of the present invention is to provide a stopwatch having a highly reliable automatic timing function with a reduced possibility of timing being influenced by an external disturbance such as an impact.

A stopwatch of the present invention comprises:

measuring circuit for measuring a primary physical quantity;

storing circuit for previously storing as a target value the value of the primary physical quantity at a point where a time is to be recorded; and recording circuit for recording a time count value at a time point where the measurement value measured by the measuring circuit coincides with the target value after the time measure is initiated.

The stopwatch of the present invention is provided with a measuring circuit for measuring a primary physical quantity and a storing circuit for previously storing as a target value the value of the primary physical quantity at a point where a time is to be recorded. It is therefore possible to ascertain whether the point, e.g., an intermediate point or a goal where a time is to be recorded has been reached or not, from the result of determination as to whether the measured value of the primary physical quantity by the measuring circuit has become equal to the target value. The stopwatch of the present invention is also provided with a recording circuit for recording a time count value at a time point where the measurement value measured by the measuring circuit coincides with the target value, after a time count has been initiated. Therefore, when the point, e.g., an intermediate point or a goal where a time to be recorded is reached, the measured time value at the corresponding time point can be recorded by the recording circuit without any operation by the user of the stopwatch. Thus, the desired time count recording can be performed without a risk of a violent fall or the like. Particularly, time count recording is performed on the basis of determination as to whether the measured value of the primary physical quantity has reached the target value, at the time point at which time recording is to be performed. As a result, the possibility of erroneous time recording caused by an external disturbance such as an impact is reduced.

In this specification, "recording by the recording circuit" includes not only storage in a memory, register and other storing circuit, but also display by display circuit. In some cases, it may be transmission of the time count value performed by using transmitting circuit to store the time count data in a remote place. Storage using the storing circuit may be a temporary or a permanent storage. In a case where only recording at a goal point may suffice, time display may be performed by using a liquid crystal display device or the like, time display may be performed simultaneously with storage by the storing circuit, or time data may be only stored by the storing circuit and may be read out afterward when necessary.

The primary physical quantity measured by the measuring circuit may be any physical quantity as long as it has a unique value at the point where time recording is to be performed after measurement is initiated. For example, to measure and record a downhill skiing time or a mountain bike running time, altitude or pressure is used as such a physical quantity. In a case where the altitude decreases monotonously from a starting point to a goal point, a split time at an arbitrary intermediate point may be uniquely measured. Even in a case where the altitude does not decrease strictly monotonously because of undulations at intermediate points between a starting point and a goal point, passing of an intermediate point or the goal point can be uniquely detected or measured as the altitude or atmospheric pressure at the point, provided that there is no other point having the same altitude as the intermediate point or the goal point. Typically, atmospheric pressure may be measured as altitude. However, a different physical quantity may be measured as altitude. The same can also be said with respect to measurement of a hang glider flight time or the like. In some cases, a plurality of physical quantities may be measured and a combination of the physical quantities may be selected to identify each of a plurality of points. For example, positional measurement with GPS may be used or combinedly used.

Preferably, the value of the primary physical quantity to be stored in advance by the storing circuit as a target value, i.e., the value of the primary physical quantity at a point such as an intermediate point or a goal at which a time is to be recorded, is a value measured previously (or preferably immediately before) at the point, with the measuring circuit of the stopwatch. In such a case, for example, even if there is an initial calibration error in the value measured by the measuring circuit of the stopwatch, a particular variation in the characteristics of the measuring circuit is directly reflected in the target value, so that the accuracy with which passage through the point is detected is high. Even if the primary physical quantity is one such as atmospheric pressure variable with respect to time, the influence of variation with respect to time is not considerable if it is in a short period of time.

In a case where the primary physical quantity at the point where a time is to be recorded can be supposed comparatively accurately on the basis of the measured value of the primary physical quantity at a point where time measurement is initiated, the supposed value at the point where time recording is to be performed may be computed on the basis of the value actually measured by the measuring circuit at the point where time measurement is initiated, instead of being previously measured at the point where time recording is to be performed. The supposed value thereby computed is stored as a target value by the storing circuit.

For example, the primary physical quantity (e.g., atmospheric pressure) may be measured at a time measurement initiation point (a starting point) by a measuring circuit, and an atmospheric pressure difference due to the difference between the altitudes of the measurement initiation point and the point at which a time measurement is to be made (such as a goal point) may be added to the measured value (atmospheric pressure value) after being corrected with a correction coefficient adjusted according to the atmospheric pressure level at the time point at which the time measurement is made, thereby obtaining a target value at the point (the goal point or the like) where time recording is to be performed. The target value obtained in this manner is stored by the storing circuit. Also in this case, a particular variation in the characteristics of the measuring circuit of the stopwatch can be partially canceled out by measurement using the measuring circuit, so that the possibility of occurrence of an error in the time count recording value is comparatively low.

In particular, for example, in the case of a skiing downhill race or the like in which a skier goes up from a goal point (where a time is to be recorded) to a starting point by a lift or the like and waits his or her turn before making a start, there is a possibility that the time period between the time point at which the physical quantity such as the atmospheric pressure is previously measured at the goal point and the time point at which the skier starts may become considerably long such that the extent of variation in the atmospheric pressure in the region where skiing will be performed may exceed a negligible level. In such a case, to minimize the influence of variation in atmospheric pressure with respect to time, the atmospheric pressure at the starting point may be measured at the time of starting, i.e., immediately before starting, or just at the time of starting, the atmospheric pressure at the goal point may be supposed by using a suitable equation for suppositional computation on the basis of the measured atmospheric pressure value and the difference between the altitudes of the starting point and the goal point. By using the supposed value as a target value, in some situations, it enables target value setting with higher accuracy.

If the physical quantity as a measurement target is stable with respect to time, a known standard value thereof may be stored as a target value by the storing circuit if desired.

In a case where variation in a primary physical quantity such as atmospheric pressure with respect to time to be measured is not negligible, the stopwatch is preferably arranged to have a correcting circuit for correcting a target value stored in the storing circuit on the basis of the tendency of variation in the physical quantity with respect to time measured by the measuring circuit. In this case, the above-described recording circuit is made to record the measured time value at the time point at which the value measured by the measuring circuit becomes equal to the target value corrected by the correcting circuit.

In the thus-arranged stopwatch, a target value itself can be corrected by the correcting circuit to minimize the influence of variation with respect to time, thereby improving the measurement accuracy. In this case, an initial target value to be corrected is, typically, a measured value actually measured at the point where time recording is to be performed. However, if the extent of variation with respect to time is considerably large, it is necessary to minimize the time interval and to limit the variation with respect to time to a monotonous increase or decrease. To do so, a supposed value at a time recording point computed on the basis of a value actually measured at the time of starting at the point where time recording is to be initiated may be set as an initial target value.

Also, this stopwatch typically has a variation tendency computation circuit for obtaining a temporal variation tendency on the basis of a value actually measured by the measuring circuit at the point where a time is to be recorded at a time point before time count is initiated, and a value actually measured by the measuring circuit at a time point at which time measurement is actually initiated. However, if the temporal variation is not a monotonous increase or monotonous decrease, it is necessary to minimize the time interval and to limit the temporal variation to a monotonous increase or monotonous decrease. To do so, a temporal variation tendency may be obtained from a supposed value at a time recording point computed on the basis of a value measured at the time of starting at the point where time recording is to be initiated, and a supposed value at the time recording point computed on the basis of a value measured at a time point a short time before at the stating point.

A stopwatch of the present invention as described above which is constructed to detect atmospheric pressure typically comprises:

time counter circuit for initiating the time count in response to a time count initiation signal and terminating the time count in response to a time count termination signal;

atmospheric pressure measuring circuit;

storing circuit;

target value setting indicator circuit for permitting an atmospheric pressure value measured by the atmospheric pressure measuring circuit to be stored in the storing circuit as a target atmospheric pressure value; and time count termination control circuit for sending a time count termination signal to the time counter circuit when an atmospheric pressure value measured by the atmospheric pressure measuring circuit coincides with the target atmospheric pressure value stored in the storing circuit: or a stopwatch comprising:

time counter circuit for initiating the time count in response to a time count initiation signal and terminating the time count in response to a time count termination signal;

atmospheric pressure measuring circuit;

storing circuit;

target value setting indicator circuit for permitting an atmospheric pressure value measured by the atmospheric pressure measuring circuit to be stored in the storing circuit as a target atmospheric pressure value;

correcting circuit for correcting the target atmospheric pressure value stored in the storing circuit on the basis of a temporal shift tendency of atmospheric pressure measured by the atmospheric pressure measuring circuit in accordance with the time elapsed; and time count termination control circuit for sending a time count termination signal to the time counter circuit when an atmospheric pressure value measured by the atmospheric pressure measuring circuit coincides with the target atmospheric pressure value corrected by the correcting circuit.

Preferred Embodiments of the present invention will be described below with reference to the accompanying drawings.

BRIEF DESICRIPTION OF THE DRAWINGS

A preferred form of the present invention is illustrated in the accompanying drawings in which:

FIG. 1 show the configuration or functions of a stopwatch in preferred embodiments of the present invention.

FIG. 3 show details of a target value input process in the flowchart of FIG. 2.

FIG. 5 show mechanical arrangements of a portion of the stopwatches shown in FIG. 1.

DETAILED DESCRIPTION OF THE PREFERRED EMBODIMENTS

Figure 1A:
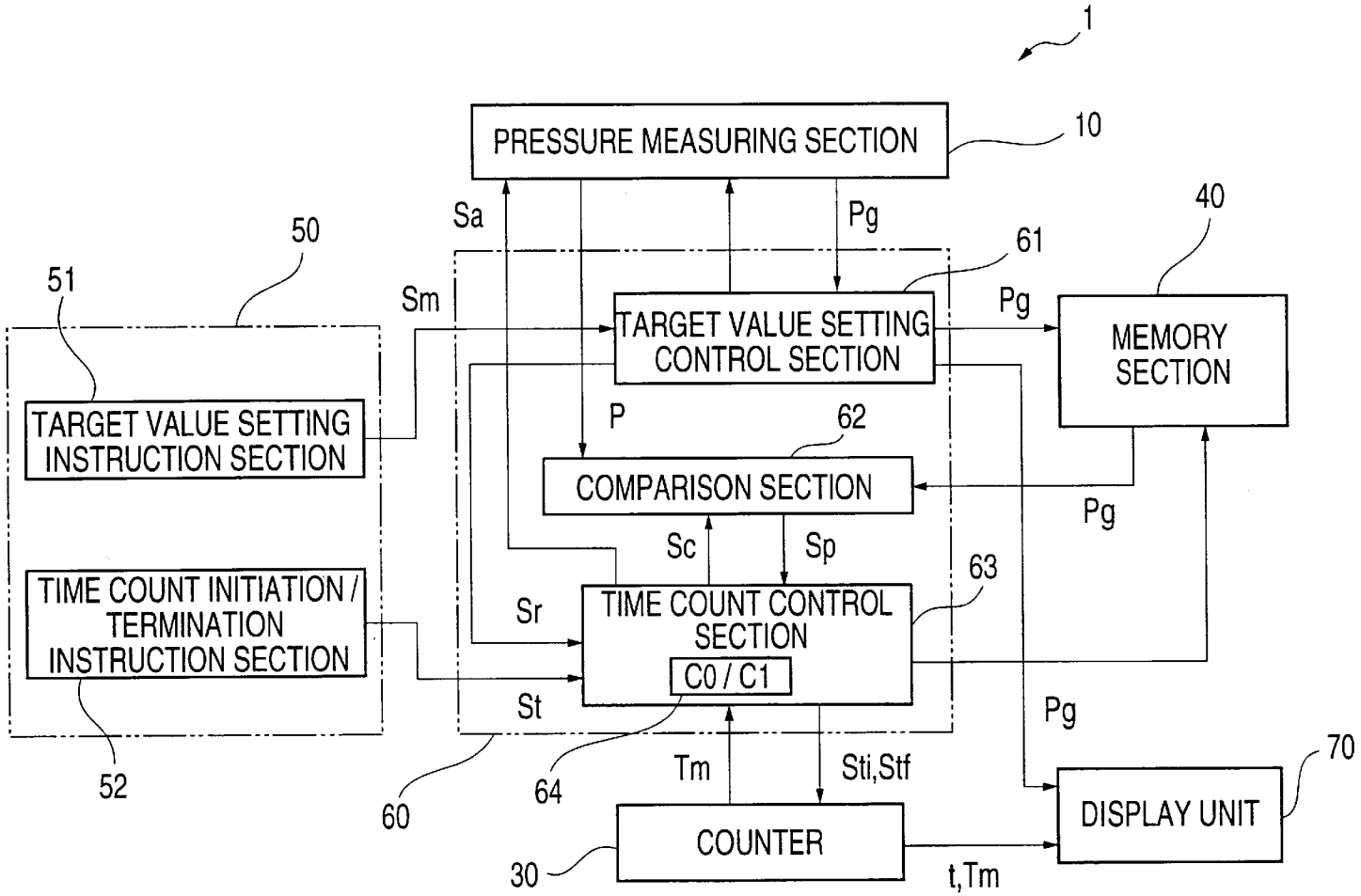
FIG. 1*a* is a block diagram of a stopwatch in a first embodiment.

A stopwatch 1 in a first preferred embodiment of the present invention has, as shown in a schematic block diagram in FIG. 1A, a pressure measuring section or a pressure sensor 10 provided as an air pressure measuring circuit or a measuring circuit for measuring an air pressure designating an altitude as a primary physical quantity, i.e., pressure P, a counter 30 provided as a time counter circuit, a storing unit 40, such as a RAM provided as a storing circuit for holding or storing a target pressure value Pg, etc., an input section 50 such as a section including input/instruction sections or input/instruction buttons 51 and 52 operated by pressing or the like to input an instruction to perform storing in the storing unit 40, or initiation or termination of time count, a control unit 60 provided as a control circuit and constituted by a computation control section of a program-controlled microprocessor, etc., and a display portion 70 such as a liquid crystal display provided as a recording circuit or display circuit. For ease of explanation in the following description, a quantity to be measured, compared and displayed is assumed to be an atmospheric pressure or a pressure P. In practice, however, pressure P may be converted into altitude H and one or both of pressure P and altitude H may be displayed.

More specifically, the control unit 60 includes a target value setting control section 61, a comparison section 62, a time count control section 63, and the like. The target value setting control section 61 receives a target value setting instruction signal Sm from the target value setting instruction section provided as a target value setting circuit, i.e., the target value setting instruction button 51, when the button 51 is operated by pressing or the like. Upon receiving the signal, the target value setting control section 61 makes the pressure sensor 10 measure pressure P, stores as a target pressure value in the storing unit 40, a pressure value Pg obtained as a result of detection or sensing by the pressure sensor 10 at the present measuring time, and further makes the display portion 70 display the target pressure value Pg.

The time count control section 63 has a time count control state memory section 64 for discriminating one state C1 or (C0) from another state C0 or (C1) in two states C1 and C0 during time count, for example. The time count control section 63 receives a time count initiation/termination instruction signal St from the time count initiation/termination instruction section, i.e., the time count initiation/termination instruction button 52, when the button 52 is operated by pressing or the like. When the time count control section 63 receives this signal while the time count control state memory section 64 is in the state C0, it sets the time count control state memory section 64 to C1, supplies a time count initiation signal Sti to the counter 30 to make the counter 30 start the time count operation, supplies a pressure measurement initiation signal Sa to the pressure sensor 10 to make this sensor start continuously measuring pressure P, and supplies a comparison initiation instruction signal Sc to the comparison section 62. A time count value or a measured time value t of the counter 30 after initiation of time count is displayed by the display portion 70.

When the comparison section 62 receives the comparison initiation instruction signal Sc, it compares the pressure P detected by the pressure sensor 10 with the target pressure value Pg stored in the storing unit 40. When the detected pressure P has the same value as the target pressure Pg, in other words, the detected pressure P becomes equal to the target pressure Pg or becomes larger or smaller than the target pressure Pg, the comparison section 62 sends a goal- or target-reaching attainment signal or a coincidence signal Sp to the time count control section 63.

When the time count control section 63 receives the coincidence signal Sp while the time control state memory section 64 is in the state C1, it sends a time count termination signal Stf to the counter 30, to make the time count operation of the counter 30 stop. When the time count is thereby terminated, the display portion 70 is maintained in a state of displaying the time period between the moment at which time count is initiated to the moment at which time count is terminated, i.e., time t=Tm. The time count control section 63 may be arranged to store the time count value Tm so that the time count value Tm can be read to the storing unit 40, which can also function as a recording circuit. In this embodiment, the comparison section 62 and the time count control section 63 form a time count termination control circuit.

When the time count control section 63 receives the time count initiation/termination instruction signal St by pressing of the time count initiation/termination instruction button 52 while the time count control state memory section 64 is in the state C1, the time count control section 63 changes the state of the time count control state memory section 64 back to the state C0, sends the time count termination signal Stf to the counter 30, to also terminate time count performed by the counter 30. This corresponds to the ordinary use of stopwatches. With respect to this use of the stopwatch 1, the stopwatch 1 may be arranged to input an instruction such as to make ineffective the pressure measurement initiation signal Sa according to the time count initiation/termination instruction signal St for instruction to initiate time count.

Figure 5A:
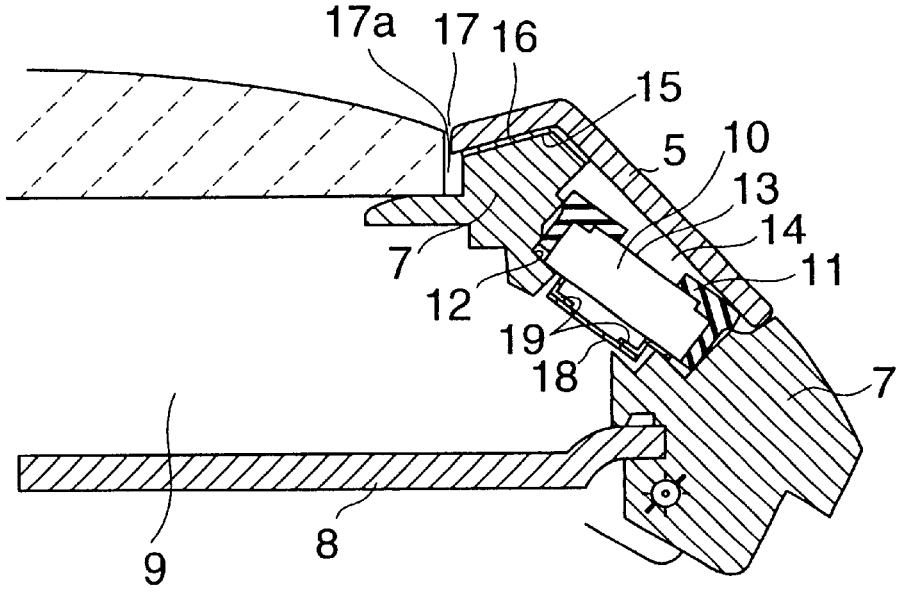
FIG. 5*a* is an enlarged cross-sectional view taken along the line VA—VA of FIG. 5*b*.
Figure 5B:
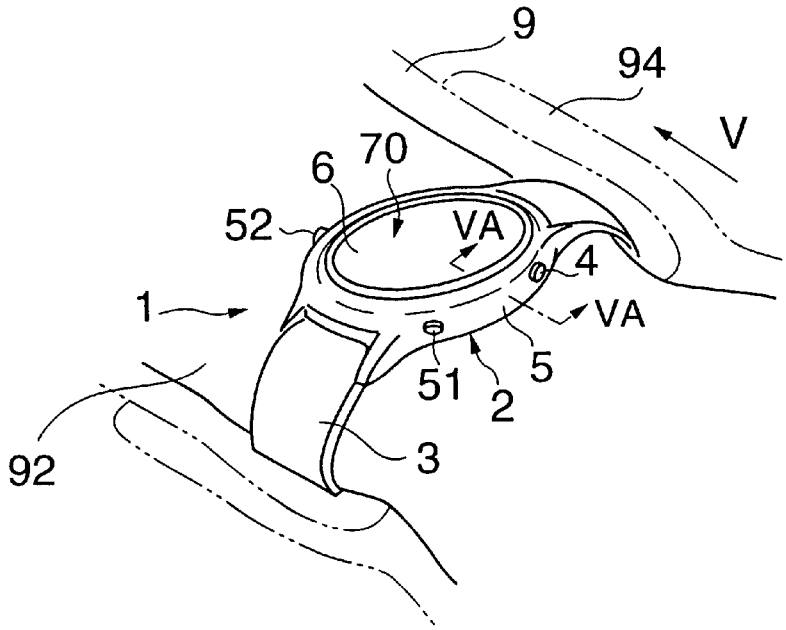
FIG. 5*b* is a perspective view of the stopwatch in a state of being worn about an arm.

The stopwatch 1 is formed as shown in FIG. 5B, for example, of namely, a main body 2 and a band 3 similar in shape to those of an ordinary watch. For example, the stopwatch 1 is changeable between an ordinary watch mode and a stopwatch mode by a push button 4. The main body 2 has an ornamental rim 5 made of a metal or the like. Further, portions corresponding to the input section 50, such as the target setting instruction button 51 and the time count initiation/termination instruction button 52, are provided in a case 7, and the display portion 70 constituted by the liquid crystal display is provided inside a glass 6. For example, the target setting instruction button and the time count initiation/termination instruction button may be combined into one common button, e.g., a button 51. In such a case, the control unit 60 (FIG. 1A) may be arranged so that pressing of the button 51 is performed as a target setting instruction operation or a time count initiation instruction operation according to, for example, a combination of the number of times the button 51 is pressed, the order in which the button 51 and the button 4 are pressed, the number of times the button 51 and button 4 are pressed.

The pressure sensor 10 constituting the pressure measuring section is placed and fixed in a recess 12 in the case 7 inside the ornamental rim 5 with a packing 11 interposed between the pressure sensor 10 and the case 7, as shown in FIG. 5A. A chamber 14 covered with the ornamental rim 5 is formed in front of a pressure sensing surface 13 of the pressure sensor 10. The chamber 14 communicates with the outside via a groove 16 formed in a surface 15 of the case 7 and functioning as a communication passage, and via a gap 17 between the inner edge of the ornamental rim 5 and the peripheral edge of front glass 6. The configuration of the communication passage 16, i.e., the shape and position of the communication passage 16, may be different from those illustrated.

The pressure sensor 10 employed may be one having its strained state changed according to a change in pressure P in the chamber 14 to change its electrical resistance, e.g., as a diffused-layer resistor formed on a silicon semiconductor chip. Needless to say, the pressure sensor 10 may be of any other type of sensor, e.g., a strain gauge of a different type or a piezoelectric transducer. A printed circuit board is indicated by 18, and a terminal for attachment of the pressure sensor 10 to the base 18 is indicated by 19.

Generally, if altitude is H, the pressure or atmospheric pressure P detected by the pressure sensor 10 is expressed by $P=Pg\exp\{-\alpha(H-Hg)/T\}$. In this equation, Hg is the altitude of a target point, Pg is the pressure (atmospheric pressure) at the target point, a is a constant, and T is temperature. That is, since pressure P decreases monotonously with the increase in altitude H, measuring pressure P with the pressure sensor 10 is equivalent to measuring altitude H.

To determine the pressure more strictly, the following equation, for example, or any other kind of equation may be used.

$$H=44332\times\{1-(P/1013.25)^{0.1903}\}$$

where H is an altitude value in m, and P is an atmospheric pressure value in hPa.

Referring to FIG. 5A, a back cover 8 is provided and the control unit 60, the storing unit 40, a counter 30, and the like, are placed in a chamber 9 surrounded by the case 7, the glass plate 6 and the back cover 8. The display 70 may be fitted in a bottom portion of the glass plate 6 or placed in an upper section of the chamber 9.

The operation or handling of the thus-arranged stopwatch 1 in the first preferred embodiment of the present invention will be described with respect to a case where the stopwatch 1 is used for timing in skiing downhill. The description will be made with reference to FIGS. 2 to 6 as well as to FIG. 1A and FIG. 5.

Figure 2:
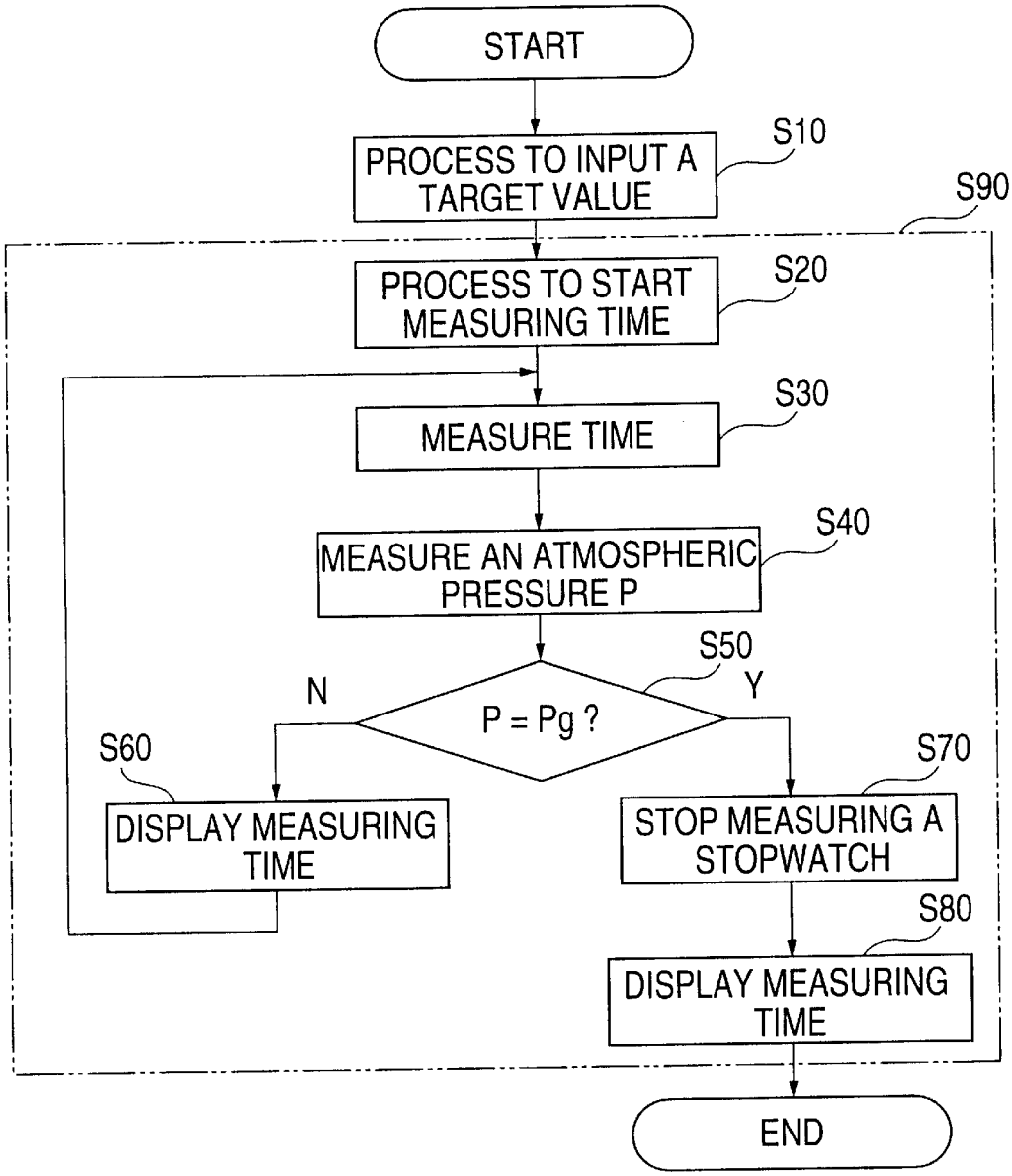
FIG. 2 is a flowchart of the general handling or operation of the stopwatches shown in FIG. 1.
Figure 6:
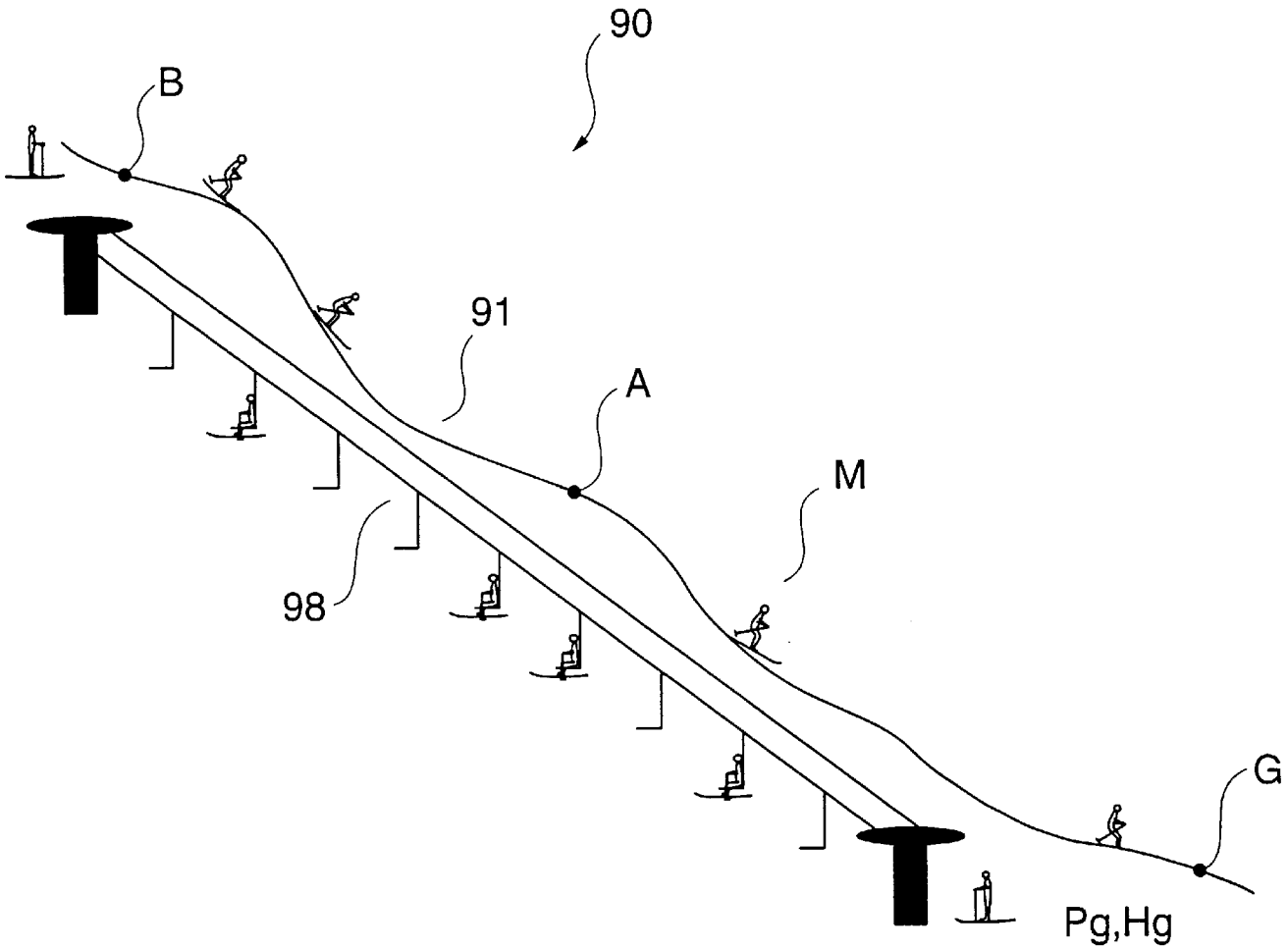
FIG. 6 is a diagram showing a skiing slope, etc., in a case where downhill skiing is performed by using the stopwatches shown in FIG. 1.

A person or a skier M who will run a downhill along a slope 91 of a mountain 90 as shown in FIG. 6 first sets or inputs a target pressure value Pg at a goal point G where the altitude is Hg and the pressure is Pg (in step S10 of the entire process shown in the flowchart of FIG. 2).

Figure 3A:
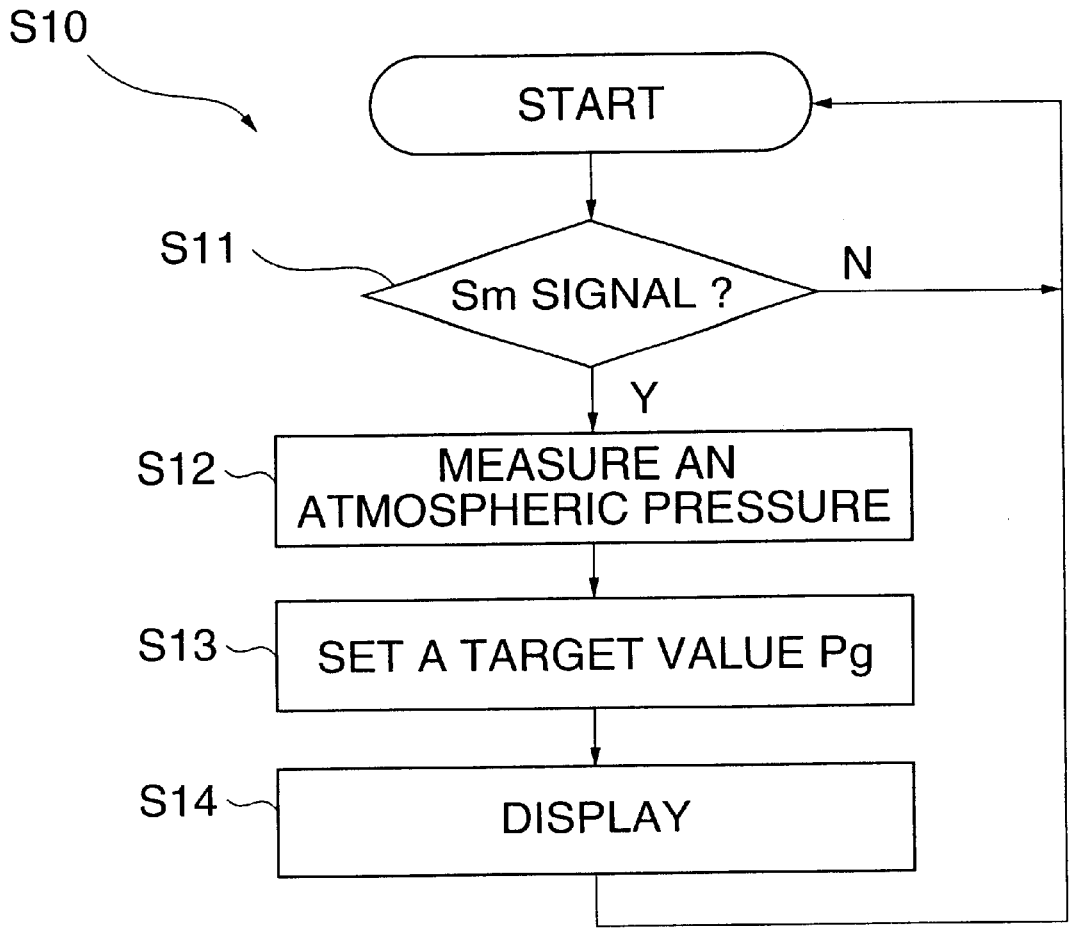
FIG. 3*a* is a flowchart showing details of the target value input process with respect to the stopwatch shown in FIG. 1*a*.

That is, the skier M sets to the stopwatch mode by button 4 (in FIG. 5B) or the like when necessary, and presses the target value setting instruction button 51 when standing at the goal point G at the foot of the mountain 90 (step S11 in the target value inputting process shown in the flowchart in FIG. 3A). Target value setting instruction signal Sm is thereby sent from the button 51 to the target value setting control section 61 (in FIG. 1A), atmospheric pressure P is measured with the pressure sensor 10 under the control of the control section 61 (step S12 in FIG. 3A), and the pressure value P=Pg measured with the pressure sensor 10 is stored in the memory 40 as a target value, i.e., the atmospheric pressure Pg at the goal point G (step S13), and is displayed by the display portion 70 (step S14). If required, the process is performed in such a manner that the pressure measurement with the pressure sensor 10 is performed at all times and the target value setting control section 61 only reads the sensor pressure P and controls storing of the read data in the memory 40 and display performed by the display portion 70. In either case, the raw atmospheric pressure value or pressure value Pg may be displayed, or the corresponding value Hg in terms of altitude may be displayed. When the target value setting control section 61 stores the target value Pg in the memory 40, it simultaneously sends a reset signal Sr to the time count control section 63 to force a reset of the time count control state memory section 64 to the state C0.

The target value Pg thereby set is used as a reference value to be referred to for termination of time count described below. The value of atmospheric pressure Pg at the goal point G may vary from day to day or with the passage of time in some cases. In practice, however, the atmospheric pressure Pg at the goal point G can be regarded as constant within a short period of time. This circuit that, during a comparatively short period after setting of the target value Pg, the pressure P at an altitude higher than that of the goal point G is smaller than Pg while the pressure P at an altitude lower than that of the goal point G is larger than Pg. Therefore, the value Pg corresponds accurately to the atmospheric pressure at the goal point G. Consequently, by comparing the measured pressure P with the target pressure Pg, it is possible to ascertain whether the goal point G is reached.

Even in a case where the pressure sensor 10 is provided as one of articles varying in characteristics and there is an initial calibration error in the pressure detected with the pressure sensor 10, indication of a particular target value Pg, e.g., Pg0 by the pressure sensor 10 used by the skier M is considered to correspond to arrival of the skier M at the target point, i.e., the goal point G, regardless of the accuracy of measurement by the pressure sensor 10.

Thus, as a result of the above-described target value Pg setting, errors from two kinds of causes can be avoided simultaneously.

Next, the skier M goes up to a starting point B on the mountain 90 by a lift 98 or the like (FIG. 6). When the skier M starts skiing downhill at the starting point B, he or she makes the stopwatch 1 perform time measurement initiation processing, i.e., time count initiation processing (step S20 of FIG. 2). That is, the skier M presses the time count initiation/termination instruction button 52 when starting skiing downhill from the starting point B (the result of step S21 in FIG. 4 which is a flowchart showing time measurement initiation processing, is "Y"). At this time, the time count state memory section 64 is set the state C0 and since time count is not being performed (the result of step S22 is "N"), the time count control section 63 therefore supplies time count initiation signal Sti to the counter 30 (FIG. 1A) in accordance with the time initiation/termination signal St, thereby starting time count with the counter 30 (step S23 of FIG. 4). The time measurement value t at the moment at which time count with the time counter 30 is started is displayed on the screen of display 70 (step S25).

Figure 4:
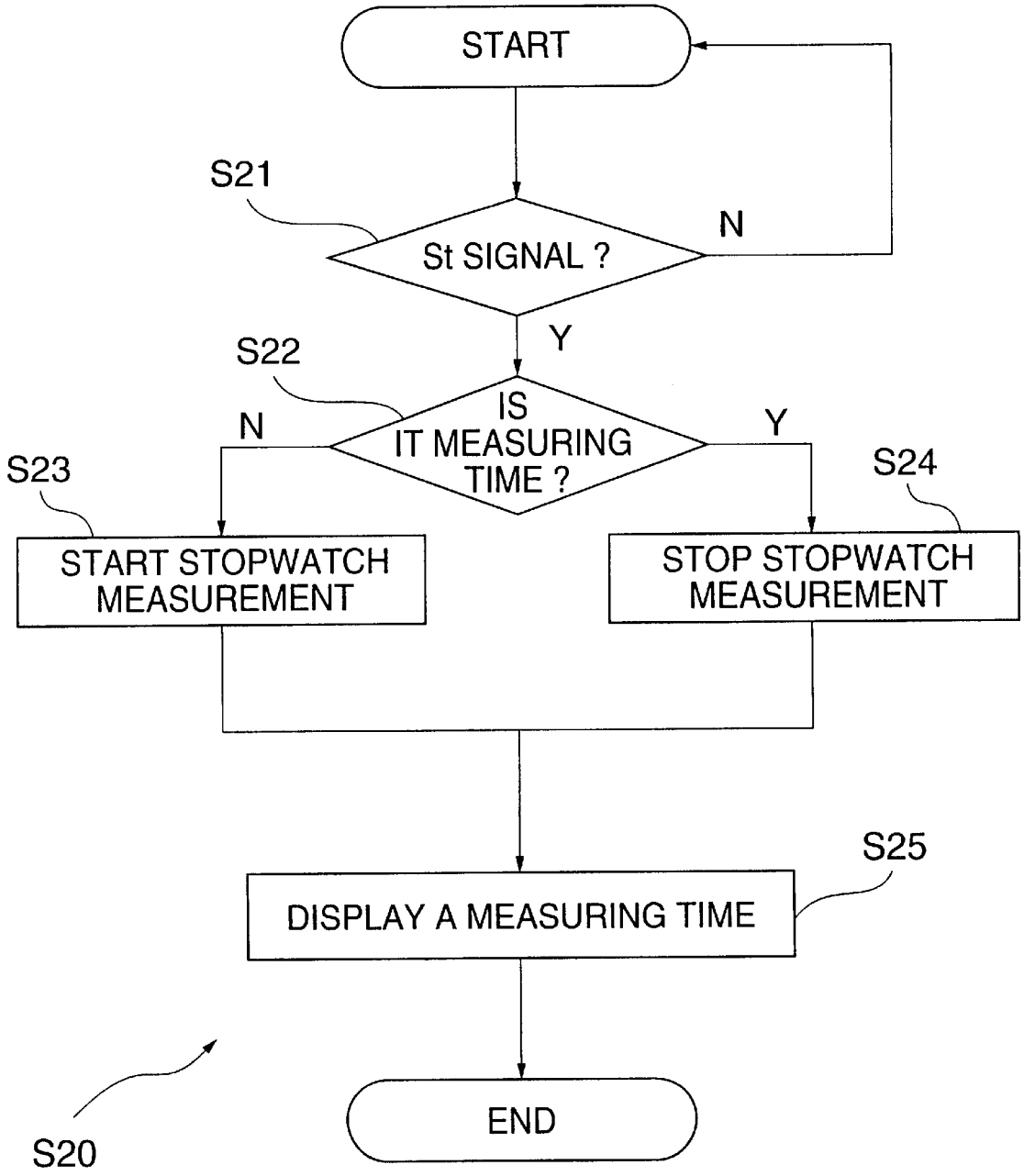
FIG. 4 is a flowchart showing details of a time measurement initiation process in the flowchart of FIG. 2.

If the ordinary stopwatch operation is performed, the button 52 (FIG. 1A) is pressed (the result of step S22 of FIG. 4 is "Y"), thereby terminating time count with the counter 30 of the stopwatch 1 (step S26). The time measurement value at the moment at which time count with the time counter 30 is terminated is displayed on the screen of the display 70 (step S25).

After time measurement initiation processing S20 has been performed, time measurement is performed continuously (step S30), and the time count control section 63 supplies pressure measurement initiation signal Sa to the pressure sensor 10, thereby initiating continuous measurement of pressure P with the pressure sensor 10. When the skier M starts skiing downhill on the course along the slope 91 substantially simultaneously with the initiation of time measurement, the altitude of the skier M decreases every moment, and the atmospheric pressure P therefore increases every moment. The atmospheric pressure P is measured with the pressure sensor 10 of the stopwatch 1 fitted around an arm 92 of the skier M as shown in FIG. 5B (step S40 of FIG. 2). Because the skier M is skiing downhill at a high speed, a high-speed air flow V is formed along the surfaces of a skiwear 93 and a glove 94 of the skier M, as shown in FIG. 5B. However, since the stopwatch 10 is covered with the skiwear 93 and the glove 94, there is substantially no air flow at an outer opening 17*a* of the gap 17 in the stopwatch 1 (FIG. 5A) and air in the opening 17*a* is therefore considered to have static pressure P according to the altitude H during downhill skiing performed by the skier M.

The pressure value P detected or measured with the pressure sensor 10 is compared with the target pressure value Pg at the goal point G by the comparison section 62 (step S50). When P is lower than Pg, the time t after initiation of time count is displayed on the display 70 (step S60). On the display 70, the pressure P at each time point (i.e., altitude H) may be displayed together with the time t. While time measurement (step S30) is being continuously performed, atmospheric pressure measurement (step S40), comparison with the target atmospheric pressure value Pg (Step S50), and display of measured time (step S60) are continued until the skier M reaches the goal point G.

When the skier M reaches the goal point G, the comparison section 62 determines that the sensor pressure P has become equal to the target pressure Pg, and the result of step S50 is "Y". At this time, the comparison section 62 sends time count termination instruction signal Sp to the time count control section 63 (FIG. 1A), the time count control section 63 sends time count termination signal Stf to the counter 30 to stop time count performed by the counter 30 (step S70), and the content of the time counter 30 when the time count is terminated is displayed on the display 70 (step S80). The entire set of steps S20 to S80 is a time measurement process S90.

Thus, when the skier M reaches a goal point G, time count by the counter 30 is terminated at t=Tm without any manual operation of the skier M and the downhill time Tm of the skier M is displayed. Thus, the skier M can measure his or her downhill time without a risk of a fall or the like. Even when the skier M receives an impact by, for example, striking against a pole during downhill skiing, the possibility of the impact or the like causing the stopwatch 1 to operate improperly is low.

While in the above-described process, only downhill time T is measured from the starting point B to the goal point G, an intermediate downhill time at any one intermediate point A or a plurality of intermediate points A may be measured if necessary. Such time measurement may be performed as described below. Each time an altitude point corresponding to one of intermediate points A is passed during lifting by the lift 98 or the like, the value of pressure Pa at the intermediate point A is set and stored as an intermediate target value, as is the target value set at the goal point G. Before or after step S50 for comparison with the target value, the detected pressure value P is compared with the intermediate pressure value Pa. If these values are equal to each other, the time count value ta at the corresponding time point is stored in the memory 40 so as to be able to be read out or displayed afterward.

In some cases in the first embodiment, the value of the target pressure Pg itself may be input and stored in the memory 40 by a manual operation or the like on the basis of information on the value of pressure at the goal point G (measured by an instrument other than, for example, the stopwatch). In such a case, the stopwatch also has the same advantage of enabling termination of time count at the goal point G without any manual operation of the skier M.

Setting of the target pressure value Pg described below may be performed instead of at the goal point, although the measurement accuracy is slightly reduced, for example, the value of pressure Pb is measured at the starting point B, the value of pressure Pg at the goal point G is computed by, for example, using the equation shown above on the basis of an altitude difference ΔH between the starting point B and the goal point G ascertained in advance, and the computed value is set as target pressure value Pg. Also in this case, the pressure along the course, which changes every day or hour, is measured at the latest time to be used as a basis for computation of the reference value Pg, thus achieving relatively higher accuracy.

Figure 1B:
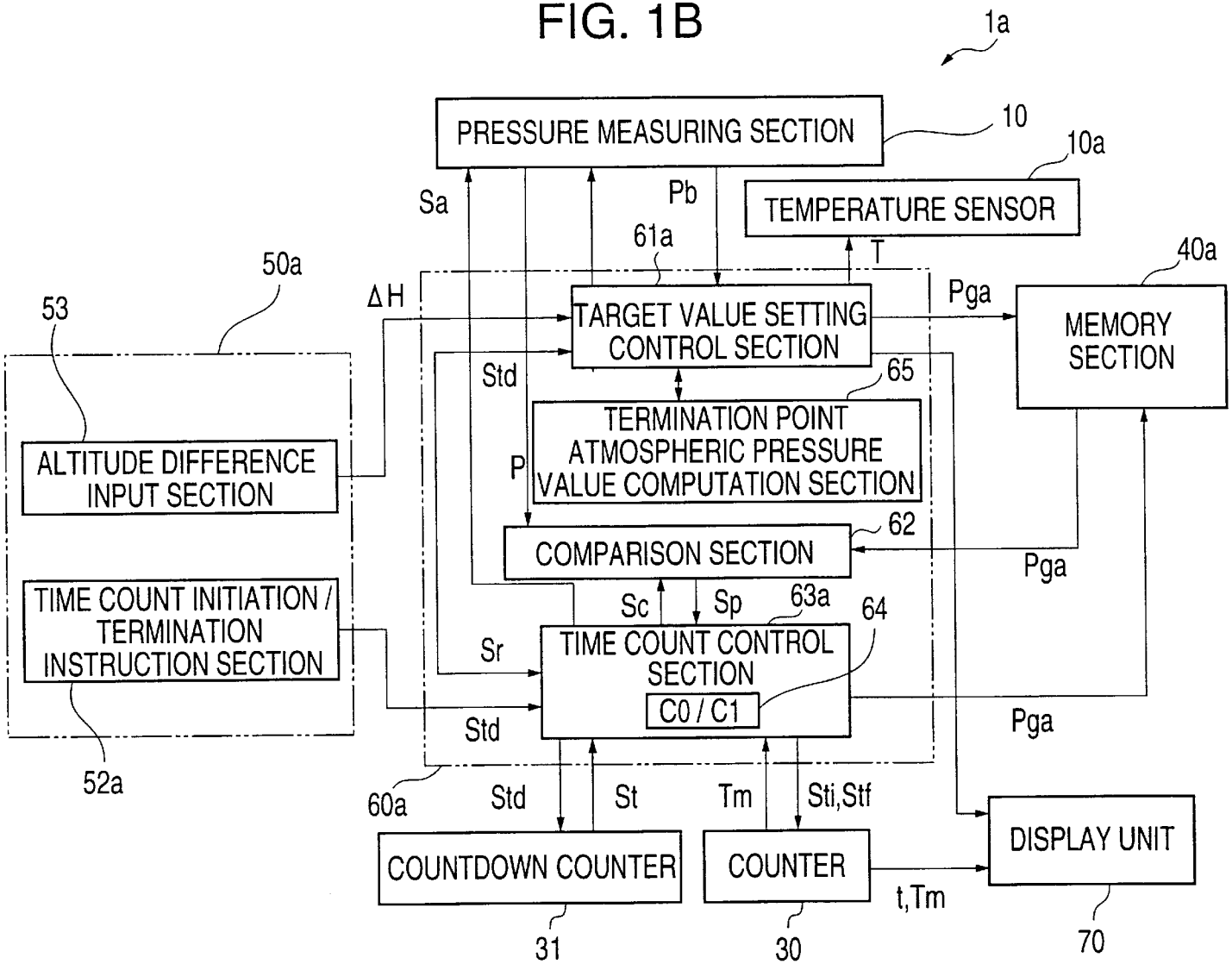
FIG. 1*b* is a similar block diagram of a stopwatch in a second embodiment.

Such an example will be described as a second preferred embodiment of the present invention with reference to the block diagram in FIG. 1B instead of FIG. 1A and to the flowchart in FIG. 3B instead of the flowchart in FIG. 3A. The second embodiment will be described in detail with respect to sections different from those in the first embodiment. In FIG. 1B, sections identical to or similar to those in the first embodiment are indicated by the same reference numerals, and sections basically similar but including different functions are indicated by the corresponding reference numerals with a suffix "a". In the flowchart in FIG. 3B, "a" is suffixed to the reference characters shown in process-step order.

In a stopwatch 1*a* shown in FIG. 1B, an input section 50*a* includes an altitude difference input section 53. For example, a button may be provided for exclusive use as the altitude difference input section 53, or the function of the altitude difference input section 53 may be performed by using together with a button 51 or 52. In either case, when a control section 61*a* is ready to accept an input formed of an altitude difference ΔH, the altitude difference input section 53 is operated to input the altitude difference ΔH between a starting point B and a goal point G. In a typical arrangement, this altitude difference ΔH is stored in a memory section 40*a* under the control of the target value setting control section 61*a*.

The stopwatch la shown in FIG. 1B also has a termination point atmospheric pressure value computation section 65 for obtaining the value of supposed atmospheric pressure Pga at a termination point, i.e., the goal point G, on the basis of the value of the atmospheric pressure Pb at the starting point B an d the altitude difference ΔH. The pressure Pga is obtained by an equation: $Pga=Pb\ \exp\{-\alpha\Delta H/T\}$, as in the above-described case. The quantity indicated by reference characters with suffix "a", in regards to just the pressure, is a supposed value obtained by the equation for computation. As temperature T, a value detected with a temperature sensor 10*a* integrally incorporated in the stopwatch 1*a* is used. However, if the temperature is known, the temperature value may be input by the altitude difference input section 53 input button. The obtained supposed value of the pressure Pga at the goal point is stored as a target value in the memory 40*a*.

In this embodiment, in a measurement initiation/termination instruction section 52*a*, not measurement initiation signal St but a countdown initiation signal Std is given, a predetermined time (e.g., about 10 seconds) before a start of measurement. That is, from the time measurement initiation/termination instruction section, more accurately by pressing a button (e.g., push button 52 in FIG. 5B) constituting the countdown initiation/measurement termination instruction section 52*a*, countdown initiation signal Std is supplied to a time count control section 63*a*. The time count control section 63*a* sends the signal Std to a countdown counter 31 to make this counter perform time count (countdown) counting "−10 (signifying 10 seconds before, subsequent numbers having the same signification), −9, −8, . . . , −3, −2, −1, 0" before a start. When the countdown counter 31 finally counts zero (0), it supplies time count initiation signal St to the time count control section 63*a*. Related operations performed subsequently are the same as those described above with reference to FIG. 1A. Needless to say, the stopwatch shown in FIG. 1A may also be arranged to enable such countdown. If necessary, the countdown counter 31 may be combined with the above-described counter 30. Countdown initiation signal Std is also supplied from the time count control section 63*a* to the target value setting control section 61*a*, which makes the pressure measuring section 10 perform detection of the value of the pressure at this time point, i.e., the value of pressure Pb at the starting point B immediately before a start, and makes the temperature sensor 10*a* detect temperature T.

Figure 3B:
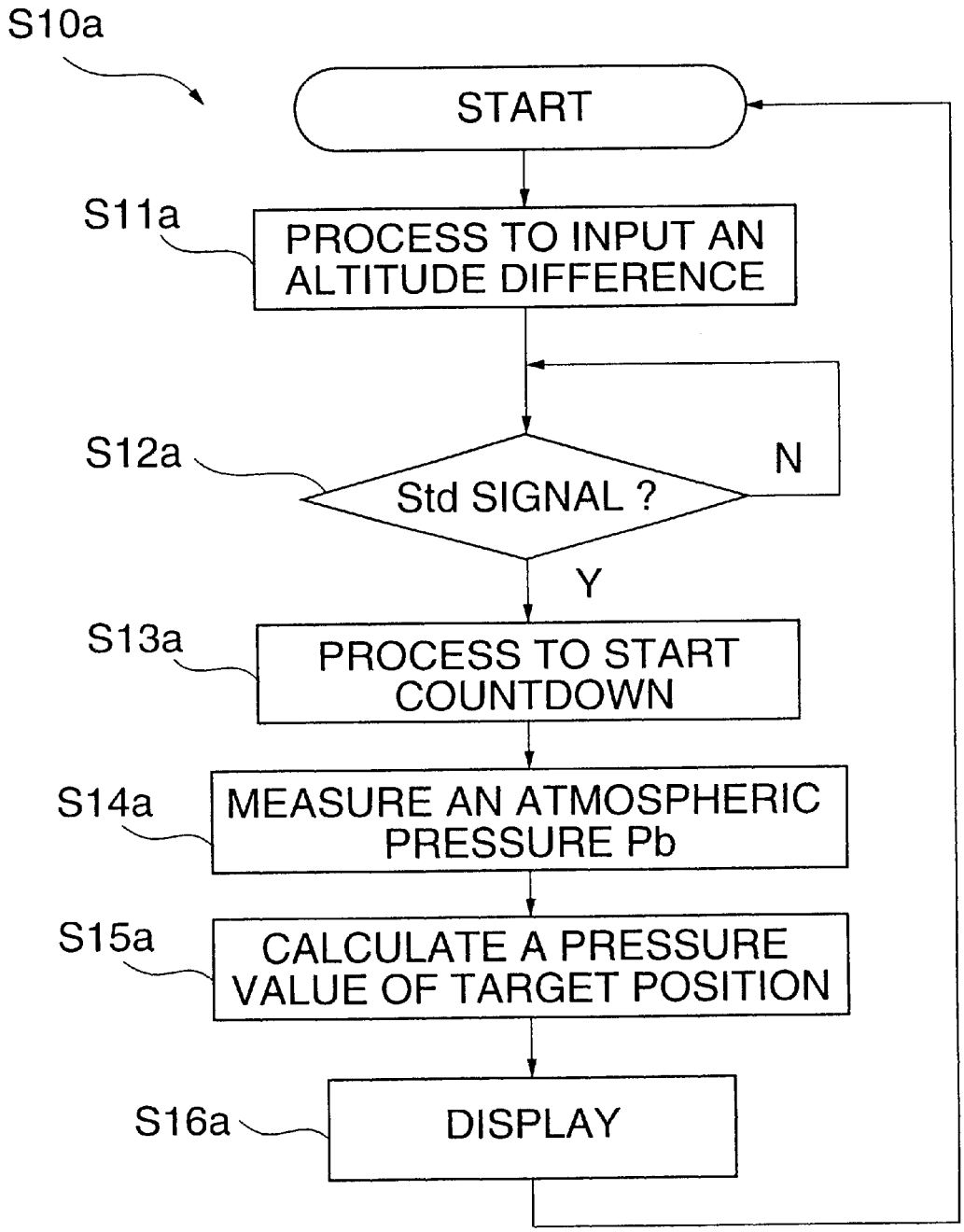
FIG. 3*b* is a flowchart showing details of the target value input process with respect to the stopwatch shown in FIG. 1*b;*

In this case, in the target value input process 10 shown in FIG. 2, a target value input process S10*a* is performed by the procedure shown in FIG. 3B instead of the procedure shown in FIG. 3A.

That is, the altitude difference input section 53 is first operated to input the altitude difference ΔH between the starting point B and the goal point G (step S11*a*). Further, at the starting point, the countdown initiation/measurement termination instruction section 52*a* is operated to instruction initiation of countdown (step S12*a*), thereby initiating the countdown operation of the countdown counter 31 (step S13*a*).

Countdown initiation signal Std is also supplied to the target value setting control section 61*a* to make the pressure measuring section 10 detect pressure Pb and make the temperature sensor 10*a* detect temperature T at the starting point B under the control of the control section 61*a*, and detected values Pb and T, respectively, are temporarily held in the control section 63*a* or stored in a desired area in the memory section 40*a* (step S14*a*). Measurement of pressure Pb and temperature T at the starting point may be performed before countdown initiation processing S13*a*. However, to minimize the influence of variations in pressure and temperature with respect to time, it is preferable to perform the measurement immediately before a start (substantially simultaneously with a start, if the short countdown time is ignored). Regarding temperature T, a value obtained as information measured by other circuit (e.g., weather information at a skiing slope) may be input, as mentioned above.

After the measurement of pressure Pb and temperature T has been completed, the value of supposed atmospheric pressure Pga at the goal point is computed by the termination point atmospheric pressure value computation section 65 under the control of the target value setting control section 61*a* (step S15*a*). The result is displayed if desired (step S16*a*).

Thus, the target value input process S10*a* (the step indicated by reference characters S10 in FIG. 2) is completed. Then, further, when the countdown counter 31 counts zero (0), time count initiation signal St is output, thus initiating time measurement initiation processing S20. That is, after step S21 of FIG. 4 with a result "Y", the same time count processing as that described above is initiated. When the count value of the countdown counter 31 designates, for example, three seconds before a start, an alarm sound generation section (not shown) is driven through the time count control section 63*a* to sound "pip" every second. When the countdown is completed, the alarm sound generation section sounds, for example "peep" to inform the user, such as a skier, that he or she should start.

The operation after time count initiation is the same as that described above except that the target value is not measured value Pg but supposed value Pga. Therefore, the description for it will be omitted.

In the case of the first embodiment, the time period between the time point ta at which the skier first measures atmospheric pressure Pg at the goal point G and the time point tb at which the skier makes a start after moving to the starting point B and waiting his or her turn, will sometimes become considerably long. In such an event, there is a possibility of the extent of variation in the atmospheric pressure in some place of the slope or the downhill course exceeding a negligible level. That is, there is a possibility of the difference between the atmospheric pressure Pg(ta) at the goal point G at the time point ta and the atmospheric pressure Pg(tb) at the goal point G at the starting time point tb being so large that the relationship between these pressure is necessarily regarded as $Pg(ta)\neq Pg(tb)$. A stopwatch 1*b* in a third embodiment arranged by considering such atmospheric pressure variation has a functional configuration shown in the block diagram of FIG. 7 instead of that shown in FIG. 1A or FIG. 1B, and functions by being operated by a procedure or process shown in the flowchart of FIG. 8 instead of that shown in FIG. 2 and FIG. 3A or FIG. 3B.

Figure 7:
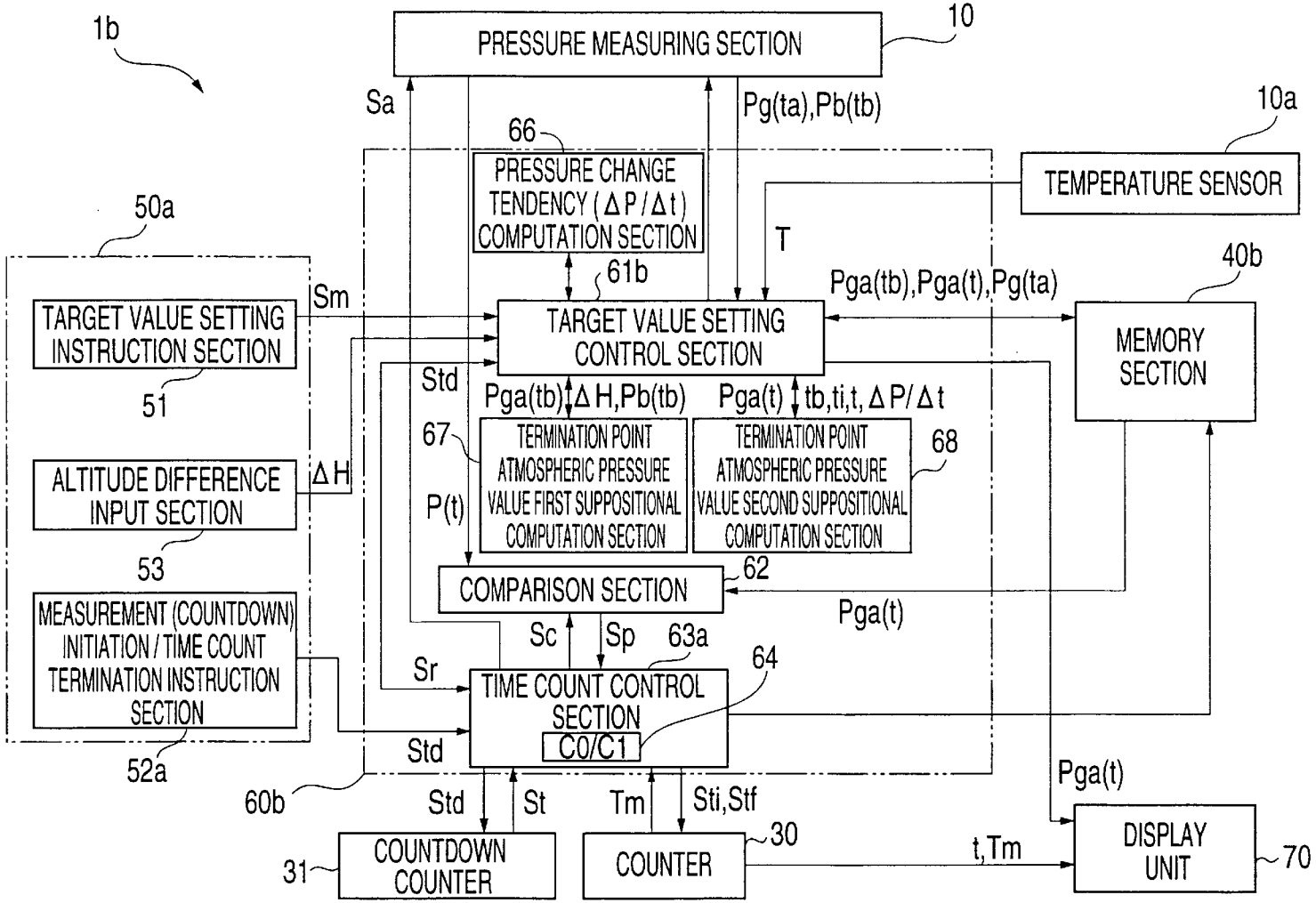
FIG. 7 is a block diagram similar to FIG. 1, showing the configuration or functions of a stopwatch in a third preferred embodiment of the present invention.

In FIG. 7, components similar to components shown in FIG. 1 are indicated by the same reference numerals, and sections or components slightly different in function are indicated by the corresponding reference numerals with a suffix "b".

As shown in FIG. 7, in comparison with the stopwatch 1*a* shown in FIG. 1B, this stopwatch 1*b* has, instead of the termination point atmospheric pressure value computation section 65, an atmospheric pressure change tendency or atmospheric pressure change rate $\Delta P/\Delta t$ computation section 66, a termination point atmospheric pressure value first suppositional computation section 67 and a termination point atmospheric pressure value second suppositional computation section 68.

The value of atmospheric pressure Pg(ta) at a goal point G at a time point ta before climbing to a starting point B is measured by a pressure measuring section 10 according to an instruction from a target value setting instruction section 51 and is stored in a memory section 40*b*, as in the stopwatch 1 shown in FIG. 1A. Also, the value of atmospheric pressure Pb(tb) at the starting point B after initiation of countdown processing, i.e., at a time point tb immediately before a start, is measured by the pressure measuring section 10 according to countdown signal Std from a countdown initiation/termination instruction section 52*a* and is stored in the memory section 40*b*, as in the stopwatch 1*a* shown in FIG. 1B. At this time, temperature T is measured with a temperature sensor 10*a* and a measurement result T is stored in the memory section 40*b*, as in the stopwatch 1*a* shown in FIG. 1B. Also, an altitude difference $\Delta H$ between the starting point B and the goal point G is stored in the memory section 40*b* according to an instruction from an altitude difference input section 53 before initiation of countdown, as in the stopwatch 1*a* shown in FIG. 1B.

The termination point atmospheric pressure value first suppositional computation section 67 computes the value of supposed atmospheric pressure Pga(tb) at the goal point G at the time point tb immediately before a start on the basis of the atmospheric pressure value Pb(tb), temperature T and altitude difference $\Delta H$ measured at the starting point B at the time point tb, and stores the computed value in the memory section 40*b*. For example, this computation is performed on the basis of the same equation as that of the corresponding computation described above.

The atmospheric pressure change tendency computation section 66, i.e., the $\Delta P/\Delta t$ computation section 66, computes an atmospheric pressure change tendency or atmospheric pressure change rate $\Delta P/\Delta t$ by $\{Pga(tb)-Pg(ta)\}/(tb-ta)$, on the basis of, for example, the value of supposed atmospheric pressure Pga(tb) at the goal point at the time point tb and the value of measured atmospheric pressure Pg(ta) at the goal point G.

Each time the value of atmospheric pressure P is measured at a downhill point at an arbitrary time point t after a start, the termination point atmospheric pressure value second suppositional computation section 68 computes the value of supposed atmospheric pressure Pga(t) at the goal point G at the latest measuring time point t by $Pga(t)=Pg(ta)+(\Delta P/\Delta t)\ (t-ta)$, on the basis of the value of measured atmospheric pressure Pg(ta) at the goal point G and the atmospheric pressure change tendency value $\Delta P/\Delta T$.

If the starting time point is ti, $t-ta=(t-ti)+(ti-ta)$, which is the sum of the time period from the time point ta at which the atmospheric pressure is first measured at the goal point G to the starting time point ti (a constant value with respect to any time point after a start of downhill skiing in one downhill run) and the latest measuring time point after the start of downhill skiing. If, for example, typically, $(ti-tb)<<(t-ti)<<(ti-ta)$, then processing may be performed by using $Pga(t)=Pga(tb)+(\Delta P/\Delta T)\cdot(t-ti)$, if required, on the assumption that $(t-ta)\sim(t-ti)+(tb-ta)$.

A comparison section 62 uses, as a target value, the latest corrected supposed goal point atmospheric pressure value Pga(t), and compares the measured atmospheric pressure value P(t) at the latest measuring point t with the latest corrected supposed goal point atmospheric pressure value Pga(t), thereby checking whether the goal point G has been reached or not.

Figure 8:
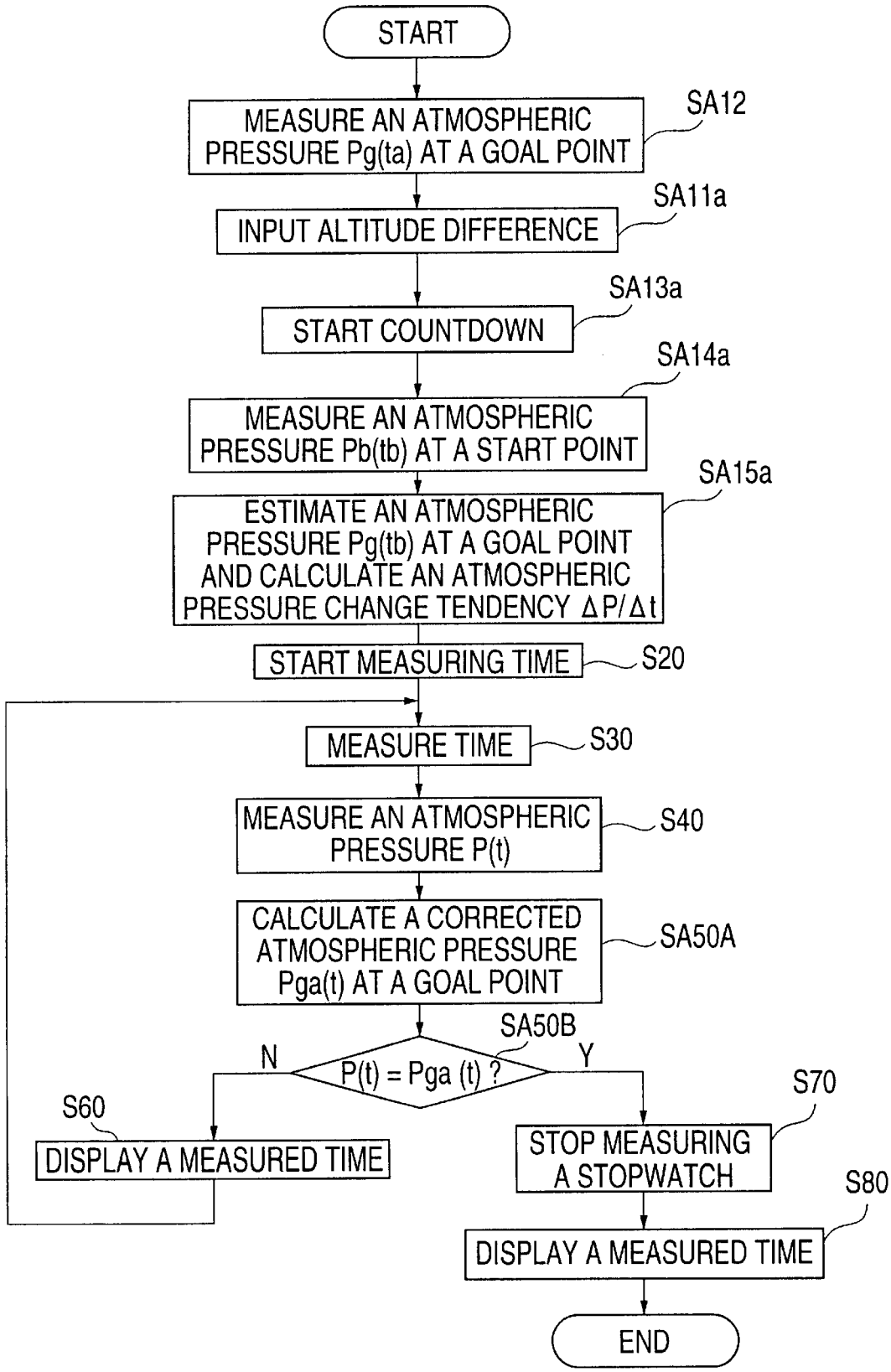
FIG. 8 is a flowchart of the general handling or operation of the stopwatch shown in FIG. 7.

The handling and operation of the thus-arranged stopwatch 1*b* shown in FIG. 7 will be described briefly with reference to the flowchart of FIG. 8.

First, the atmospheric pressure Pg(ta) at the goal point G is measured with the pressure measuring section 10 according to an instruction from the target value setting instruction section 51, and is stored in the memory section 40*b* (step SA12). This step SA12 is substantially the same as step S12 in FIG. 3A, except that the measuring time information ta is obtained from a timing section (not shown) in the watch and is also stored in the memory section 40*b*. In FIG. 8, step S11 in FIG. 3A is omitted. A time measuring counter which is reset to, for example, zero (0) at the time point ta may be provided separately. Needless to say, this counter may be combined with the counter 30 if necessary.

Next, the altitude different input section 53 inputs altitude difference $\Delta H$ (step SA11*a*). This step SA11*a* may be performed at the starting point. However, it may be performed at the goal point G, or in some case, before step SA12 according to one's need.

Next, the countdown initiation/termination instruction section 52*a* initiates countdown at the starting point B (step SA13*a*). This step SA13*a* is the same as countdown initiation processing shown in steps S12*a* and S13*a* in FIG. 3B.

Next, at the time point tb after initiation of countdown, the atmospheric pressure Pb(tb) at the starting point B is measured (step SA14*a*). This step SA14*a* is the same as step S14*a* in FIG. 3B, except that measuring time information tb is also stored in the memory section 40*b*, as is the information in step SA12*a*.

Next, in the course of countdown, the value of supposed atmospheric pressure Pba(tb) at the goal point G at the time point tb is obtained by the termination point atmospheric pressure first suppositional computation section 67. The value of atmospheric pressure Pb(tb) at the goal point is supposed to thereby be stored in the memory section 40*b* (the first half of step SA15*a*). Further, the atmospheric pressure change tendency $\Delta P/\Delta T$ is obtained as described above and stored in the memory section 40*b* (the second half of step SA15*b*).

After the completion of countdown by the countdown counter 31, time measurement is initiated (step S20), time t is measured (step S30), and the atmospheric pressure P(t) at the time point t is measured (step S40). These steps S20 to S40 are the same as the above-described corresponding steps.

Each time the atmospheric pressure P(t) is performed, the value of supposed atmospheric pressure Pga(t) at the goal point G at the corresponding time point t is obtained by correction performed by the termination point atmospheric pressure second suppositional computation section 63*d* (step SA50A). As long as step SA50A is performed after step S30, it is desirable to simultaneously perform steps S30 and S50A and the step S40 if possible. The order of these steps in the flowchart may be changed, or performed in parallel with each other as much as possible.

Comparison is performed in the comparison section 62 to ascertain whether the measured atmospheric pressure value P(t) has become equal to the supposed target atmospheric pressure value Pga(t) (step SA50B). This step SA50B is substantially the same as steps S50 and S50*a* in FIG. 3B except that the target value Pga(t) is a value corrected every moment.

Measurement is repeated as described above until the target value is reached. When the target value is reached, measurement with the stopwatch 1*b* is terminated (step S70) and the measured time is displayed (step S80). These steps S70 and S80 are substantially the same as steps S70 and S80 in FIG. 3A and FIG. 3B.

The description has been made with respect to downhill skiing by way of example. However, the stopwatch 1 can also be used for measurement in other sports, for example, measurement of mountain bike running time and hang glider flight time. Also, an example of use of a pressure sensor as a sensor for detecting a physical quantity has been described since the pressure or altitude is a physical quantity suitable for representing a location in downhill skiing or the like. However, the physical quantity to be measured may be changed as desired if the time measurement object is changed.

What is claimed is:

1. A stopwatch for timing an event, comprising:

a measuring circuit for measuring a primary physical quantity that varies as the event progresses;

a storing circuit for storing prior to occurrence of the event a target value comprised of the value of the primary physical quantity at a point during the event where elapsed time is to be recorded, the target value being an estimated value of the primary physical quantity at the point where the time is to be recorded, the estimated value being obtained by deduction based on an actual value of the primary physical quantity that is measured by the measuring circuit at a point where the elapsed time count is to be initiated; and a recording circuit for recording an elapsed time count value at a time point where the measurement value measured by the measuring circuit coincides with the target value after a time count has been initiated.

2. A stopwatch for timing an event, comprising:

a measuring circuit for measuring a primary physical quantity that varies as the event progresses;

a storing circuit for storing prior to occurrence of the event a target value comprised of the value of the primary physical quantity at a point during the event where elapsed time is to be recorded;

a recording circuit for recording an elapsed time count value at a time point where the measurement value measured by the measuring circuit coincides with the target value after a time count has been inititated; and a correcting circuit for correcting the target value stored in the storing circuit on the basis of a temporal shift tendency of a physical quantity measured by the measuring circuit; wherein the recording circuit records a time count value at a point where the target value corrected by the correcting circuit coincides with a measurement value of the primary physical quantity measured by the measuring circuit.

3. A stopwatch according to claim 2; further comprising a shift tendency calculating circuit for obtaining, prior to initialization of the time count, a temporal shift tendency on the basis of an actual measurement value of the primary physical quantity measured by the measuring circuit at the point where the elapsed time is to be recorded; and an actual measurement value of the primary physical quantity measured by the measuring circuit at the point where the time count is to be initiated at a point in time where the time count is actually initiated.

4. A stopwatch comprising:

a time counter circuit for initiating a time count in response to a time count initiation signal and terminating the time count in response to a time count termination signal;

an atmospheric pressure measuring circuit;

a storing circuit;

a target value setting indicator circuit for storing an atmospheric pressure value measured by the atmospheric pressure measuring circuit in the storing circuit as a target atmospheric pressure value; and a time count termination control circuit for automatically sending a time count termination signal to the time counter circuit when an atmospheric pressure value measured by the atmospheric pressure measuring circuit coincides with the target atmospheric pressure value stored in the storing circuit so that an elapsed time is measured without manual terminal of an elapsed time count.

5. A stopwatch comprising:

a time counter circuit for initiating a time count in response to a time count initiation signal and terminating the time count in response to a time count termination signal;

an atmospheric pressure measuring circuit;

a storing circuit;

a target value setting indicator circuit for storing an atmospheric pressure value measured by the atmospheric pressure measuring circuit in the storing circuit as a target atmospheric pressure value;

a correcting circuit for correcting the target atmospheric pressure value stored in the storing circuit on the basis of a temporal shift tendency of atmospheric pressure measured by the atmospheric pressure measuring circuit in accordance with elapsed time; and a time count termination control circuit for automatically sending a time count termination signal to the time counter circuit when an atmospheric pressure value measured by the atmospheric pressure measuring circuit coincides with the target atmospheric pressure value corrected by the correcting circuit so that an elapsed time is measured without manual terminal of an elapsed time count.

6. A stopwatch for measuring an elapsed time of an event, comprising:

a sensor for sensing a physical quantity that varies as the event progresses and outputting a corresponding signal;

a storing circuit for storing a target value comprising a value of the physical quantity at a point in time at which the elapsed time of the event is to be measured, the target value being determined and stored prior to the event; and a processing circuit for automatically determining the elapsed time when the physical quantity measured by the measuring circuit coincides with the target value after a time count has been initiated.

7. A stopwatch according to claim 6;

wherein the target value is an actual value of the physical quantity that is measured by the sensor before the time count has been initiated at a location where the elapsed time is to be measured.

8. A stop watch according to claim 6;

wherein the target value is an estimated value of the physical quantity at the point where the elapsed time is to be measured, the estimated value being obtained by calculation based on an actual value of the physical quantity that is obtained by the sensor at a point where the event is to be commenced.

9. A stopwatch according to claim 6; further comprising a correcting circuit for correcting the target value based on an error in the physical quantity measured by the sensor, so that the elapsed time is determined as a point in time when the target value corrected by the correcting circuit coincides with a value of the physical quantity measured by the sensor.

10. A stopwatch according to claim 8; further comprising a shift tendency calculating circuit for obtaining a temporal shift tendency of the measured physical quantity by measuring the physical quantity at a point where the elapsed time is to be measured, before the event commences, and an actual measurement value measured by the measuring circuit at the point where the event is to be initiated at a point in time when the even is actually initiated.

11. A stopwatch according to claim 6;

wherein the physical quantity is altitude.

12. A stopwatch according to claim 11;

wherein the sensor senses an atmospheric pressure.

* * * * *